US006179335B1

(12) United States Patent
DeLise, Jr.

(10) Patent No.: US 6,179,335 B1
(45) **Date of Patent: *Jan. 30, 2001**

(54) PRODUCT LABEL BEARING AN INSTRUCTIONAL BOOKLET

(75) Inventor: Stephen W. DeLise, Jr., West Islip, NY (US)

(73) Assignee: Minigraphics, Inc., Freeport, NY (US)

( * ) Notice: Under 35 U.S.C. 154(b), the term of this patent shall be extended for 0 days.

This patent is subject to a terminal disclaimer.

(21) Appl. No.: 09/375,956

(22) Filed: Aug. 17, 1999

(51) Int. Cl.[7] ..... B42D 15/00

(52) U.S. Cl. ..... 283/61; 283/62; 283/81; 281/2; 281/3.1; 281/5; 428/40

(58) Field of Search ..... 283/81, 56, 61, 283/62, 63.1; 462/7; 428/40.1, 42.1, 43; 281/2, 3.1, 5

(56) References Cited

U.S. PATENT DOCUMENTS

| | | | | |
|---|---|---|---|---|
| Re. 34,366 | | 9/1993 | Instance . | |
| 789,290 | * | 5/1905 | Norrington . | |
| 3,163,447 | * | 12/1964 | Seeking . | |
| 4,097,067 | * | 6/1978 | Schechter | 283/56 |
| 4,583,763 | * | 4/1986 | Schacklet, Jr. | 281/5 |
| 4,592,572 | | 6/1986 | Instance . | |
| 4,680,080 | | 7/1987 | Instance . | |
| 4,744,591 | | 5/1988 | Instance . | |
| 4,747,618 | | 5/1988 | Instance . | |
| 4,991,878 | | 2/1991 | Cowan et al. . | |
| 4,997,205 | * | 3/1991 | Hansch | 281/2 |
| 5,263,743 | * | 11/1993 | Jones | 283/81 |
| 5,324,559 | | 6/1994 | Brombacher . | |
| 5,399,403 | | 3/1995 | Instance . | |
| 5,458,374 | * | 10/1995 | Vijuk et al. | 283/81 |
| 5,588,239 | | 12/1996 | Anderson . | |
| 5,685,530 | | 11/1997 | DeLise . | |
| 5,700,537 | | 12/1997 | Instance . | |
| 5,727,819 | | 3/1998 | Grosskopf et al. . | |
| 5,736,210 | * | 4/1998 | Treleaven | 428/40.1 |
| 5,738,382 | * | 4/1998 | Grosskopf et al. | 283/81 |
| 5,766,716 | * | 6/1998 | Barry | 428/40.1 |
| 5,804,271 | | 9/1998 | Barry . | |
| 5,813,700 | * | 9/1998 | Vijuk et al. | 283/81 |
| 5,830,550 | | 11/1998 | Treleaven et al. . | |
| 5,857,705 | * | 1/1999 | Dahlquist | 281/5 |
| 5,863,628 | | 1/1999 | Barry . | |
| 5,866,219 | * | 2/1999 | McXlure et al. | 428/40.1 |
| 5,909,899 | * | 6/1999 | Vijuk et al. | 283/81 |
| 5,975,575 | * | 11/1999 | Instance | 281/2 |
| 5,975,582 | * | 11/1999 | Treleaven | 283/81 |
| 6,027,598 | * | 2/2000 | Anderson | 283/103 |
| 6,027,780 | * | 2/2000 | Treleaven et al. | 428/40.1 |

* cited by examiner

*Primary Examiner*—Henry Tsai
*Assistant Examiner*—Alisa L. Thurston
(74) *Attorney, Agent, or Firm*—Keusey & Tutunjian, P.C.

(57) ABSTRACT

A two part identifying and instructional booklet having a label part and a booklet part. The front of the label has a small unvarnished region. The booklet is folded and glued closed with the free edges secured interiorly. An adhesive is printed onto the unvarnished region of the label and the folded booklet is adhered to the unvarnished region. The booklet has a tab portion to facilitate opening of the book during use. The tab portion faces the identifying portion of the label which extends longitudinally outwardly from the unvarnished region. The label may be placed onto a cylindrical container and bent in the longitudinal direction whereby the spine and folds of the booklet remain straight, flat and parallel to each other.

20 Claims, 3 Drawing Sheets

PRODUCT LABEL BEARING AN INSTRUCTIONAL BOOKLET

BACKGROUND OF THE INVENTION

1. Field of the Invention

The present invention relates to a product label bearing an instructional multi-page booklet. More particularly, it relates to a configuration of the multi-page booklet wherein the elongated pages are folded over to enclose the free ends thereof.

2. Prior Art

Frequently product containers are identified by applying an adhesive-backed label to an outer surface of the container. Such labels retain their product-identifying purpose by remaining permanently affixed to the container.

Certain products which require extensive instructions or which are subject to significant government regulations require additional printed matter which is typically inserted into the product container. In the case of pharmaceuticals, the printed matter may be in the form of printed sheets, printed inserts, or printed outserts. An example of such may be seen in U.S. Pat. No. 5,685,530. While these various forms of printed matter have the benefit of providing a relatively large amount of information, their overall effectiveness is limited if they become separated from the product container.

Fold-out labels made from single sheets are shown in U.S. Pat. No. Re. 34,366 and U.S. Pat. No. 5,830,550. An example of a booklet which incorporates certain advantages of a label is disclosed in U.S. Pat. No. 5,324,559. The patent discloses a relatively simple booklet containing four sheets, i.e., eight pages. In all of these patents, the first page contains information which would otherwise be placed on the product label. The entire back page is adhered to the container leaving only the intermediate pages for instructional information. A further drawback of these patents lies in the fact that if their first page becomes detached from the booklet the product container would be unlabeled.

Accordingly, it would be desirable to provide an identifying and instructional document which combines the permanent nature of an adhesive label with the instructional capacity of a multi-page booklet.

SUMMARY OF THE INVENTION

It is therefore an object of the present invention to overcome the drawbacks of the prior art and to provide a permanent identifying label in combination with a large capacity instructional booklet.

It is further an object of the present invention to mount the booklet onto the label such that the entire assembly can be adhered to the product just like a conventional label.

It is another object of the present invention to provide such a booklet wherein the free ends are enclosed within the folds of the booklet.

It is a further object of the present invention that only a minor portion of one page be utilized in securing the booklet to the label.

These and other related objects are achieved according to the invention by providing a label which is adhered to a product container with its outer surface being visible to the user. A portion of the outer surface contains identifying indicia, for example printed text covered by varnish to impart scuff resistance and water resistance thereto. Another portion of the label constitutes an unvarnished region.

In combination with the label, there is provided a booklet including two or more sheets which are bound together at one end forming a. spine. Starting at the free end of the booklet, opposite the spine, a minimum of three panels are folded over to enclose the free ends inside of the final folded booklet. To secure the booklet in its folded form, one or more dots of permanent or releasable adhesive are applied, for example on the cover page adjacent the spine. The folded, secured booklet is attached to the label by adhering it to the unvarnished region of the label which has a releasable or permanent adhesive printed thereon.

BRIEF DESCRIPTION OF THE DRAWINGS

Other objects and feature of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
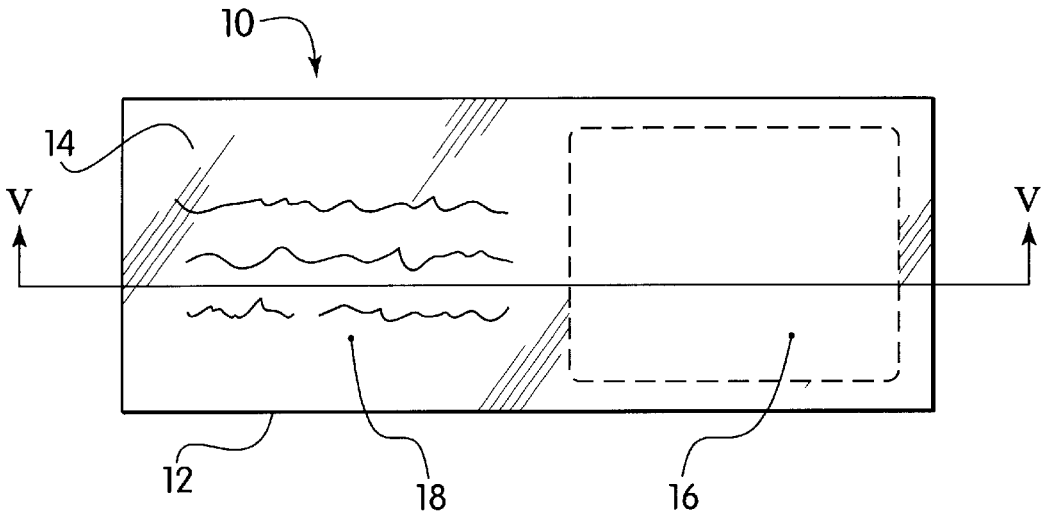
FIG. 1 is a front side elevational view of an identifying label which forms one part of the document according to the invention.

Referring now in detail to the drawings and in particular FIG. 1, there is shown a label 10 forming the identifying part of the document according to the invention. Another instructional part of the document is shown in the other figures. In the context of this application the word "document" bears one of its ordinary meanings—a writing conveying information. As used herein, the word document includes labels with writing or other identifying indicia. As used herein, document also includes booklets containing writing, drawings, diagrams or other meaningful content in any form.

Label 10 has a backside 12 which may be provided with a permanent adhesive 13 for attachment to a product container. A release backing (not shown) covers adhesive 13 during manufacturing and is removed just prior to use. Label 10 also includes a front side 14 divided into an unvarnished region 16 and a further region 18 containing identifying printed matter under a protective varnish. Unvarnished region 16 is preferably square or rectangular in shape conforming in size to the base panel of the booklet which will be described in greater detail below. In order to mount the booklet, unvarnished region 16 is covered with a releasable or permanent adhesive 50, for example by printing the adhesive uniformly across the entire region 16.

Figure 2A:
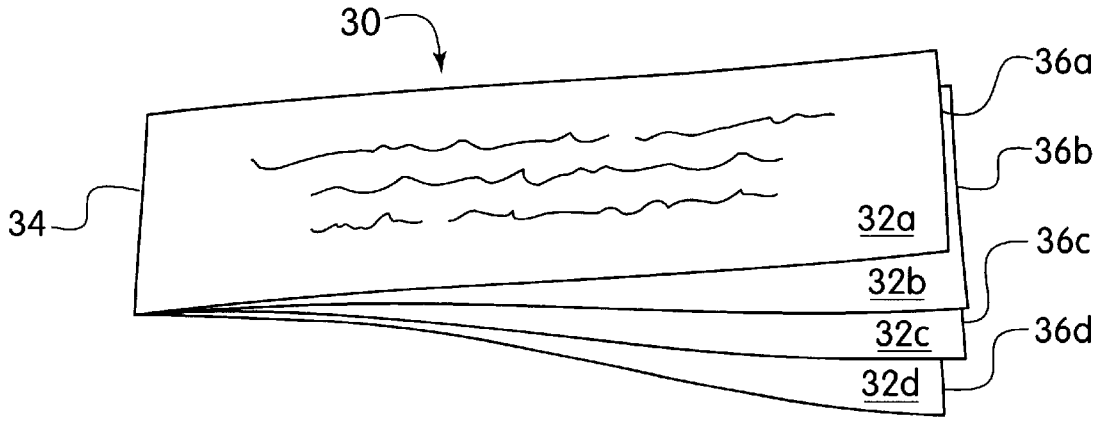
FIG. 2A is a perspective view of a multi-page booklet which forms the second part of the document.
Figure 2B:
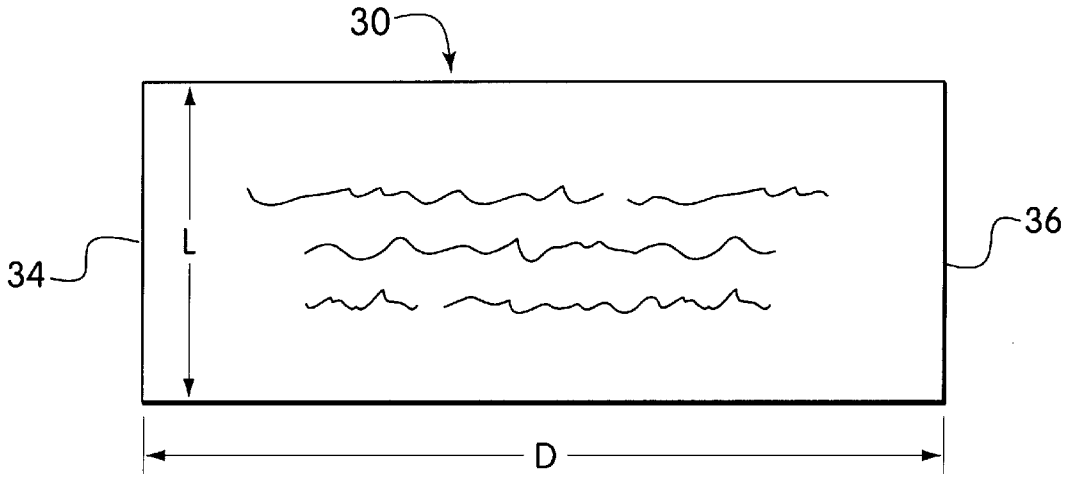
FIG. 2B is a front side elevational view of the booklet.
Figure 2C:
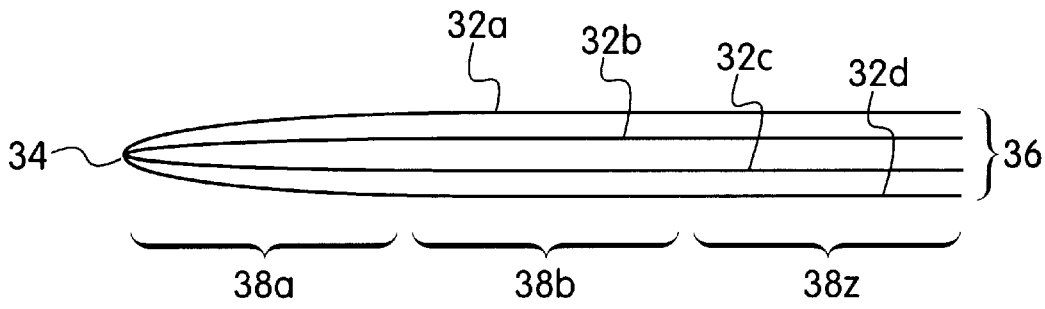
FIG. 2C is a bottom side elevational view of the booklet.

FIGS. 2A, 2B and 2C show various views of a multi-page booklet 30 forming the instructional part of the document according to the invention. The booklet includes two or more sheets, and for the purposes of illustration, the booklets here are shown with four sheets 32*a*, 32*b*, 32*c* and 32*d*. The sheets are bound together at one end thereof, for example with adhesive, to form a spine 34. It should be understood that any number of single sheets or folded over double sheets may be used to form the booklet. In one embodiment, sheets 32*a* and 32*d* are a unitary piece folded in half. In addition, sheets 32*b* and 32*c* are another unitary piece folded in half. The unitary pieces are glued together at the folds. In addition the separate sheets within the booklet may originate from the same or multiple master sheets. Opposite spine 34 each sheet has a free end 36*a*, 36*b*, 36*c* and 36*d*, which are collectively referred to as 36.

In practical embodiments thereof, Length L of spine 34 is equal to the corresponding dimension of unvarnished region 16. Alternatively, Length L is equal to or is slightly smaller than the corresponding dimension of label 10. For example, unvarnished region 16 may extend across the entire length of label 10. Distance D is at least two to three times longer than Length L or the corresponding dimension of unvarnished region 16.

FIG. 2C shows the booklet divided into three generally equally-sized panels consisting of spine panel or base panel 38*a*, intermediate panel 38*b* and end panel 38*z*. While a minimum of three panels is required, longer sheets may be divided into four or more generally equally-sized panels without detracting from the spirit and scope of the invention. Interior panel, may be shorter than the exterior panels. For example, end panel 38*z* may be significantly shorter than the other panels, thereby forming a short leg. In general spine panel 38*a* is slightly shorter than the adjacent exterior panel, as will be discussed in greater detail below.

Figure 3A:
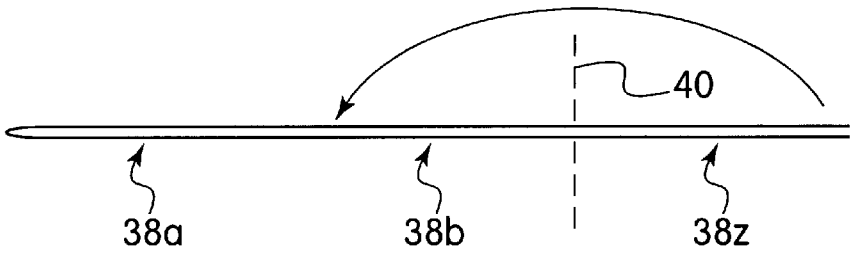
FIGS. 3A, 3B and 3C are further bottom side elevational views illustrating a sequence of two folds to form a first embodiment of a folded, secured folded booklet.
Figure 3B:
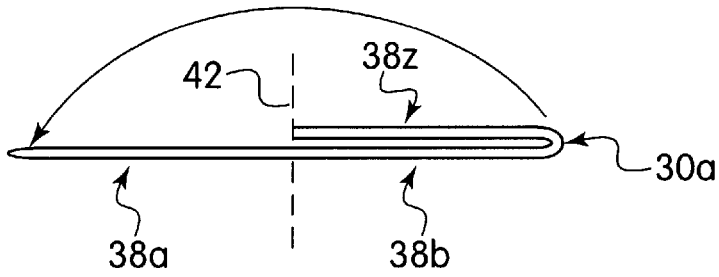
Figure 3C:
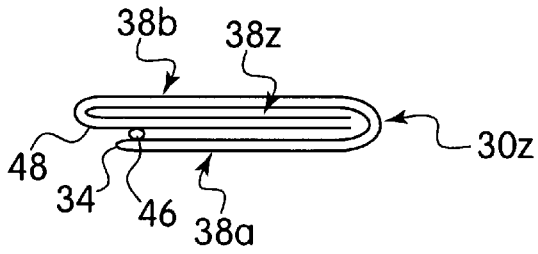
Figure 4:
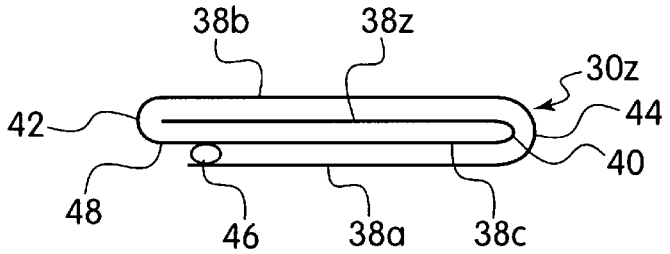
FIG. 4 is a bottom side elevational view illustrating another embodiment of a secured booklet having three folds.

FIGS. 3A, 3B and 3C show the booklet from FIG. 2C in schematic form and illustrate an example of folding end panel 38*z* along fold line 40 onto intermediate panel 38*b* to form a first folded booklet 30*a*. First folded booklet 30*a* is then folded along second fold line 42 and secured with an adhesive dot, bead or region 46 to form final folded booklet 30*z*. FIG. 4 shows the booklet from FIG. 2C in schematic form in another example of a final folded booklet 30*z* which includes an additional intermediate panel 38*c* and a third fold line 44. It should be noted that in FIG. 3C and FIG. 4 spine panel 38*a* defines a short leg wherein the remaining panels extend outwardly beyond spine 34 thereby providing a tab portion 48.

In a practical embodiment of the folded booklet shown in FIG. 3C, Distance D is about three times Length L. When folded over twice, the folded booklet is approximately square. In a practical embodiment of the folded booklet shown in FIG. 4, Distance D is about four times Length L. When folded over three times, the folded booklet is approximately square.

Figure 5:
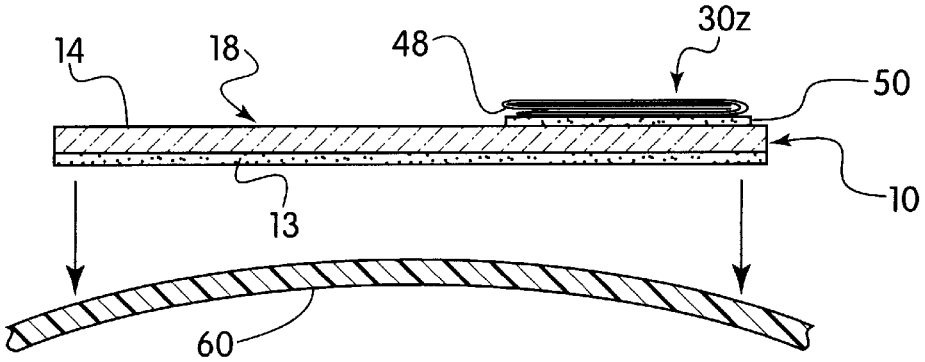
FIG. 5 is a cross-sectional view from FIG. 1 taken along the line V—V showing the adhesive backed label with either folded, secured booklet mounted thereon.

FIG. 5 shows label 10 with an adhesive 50 printed onto the unvarnished region 16. One of the final folded booklets 30*z* is mounted onto adhesive layer 50 whereby the entire back surface of spine panel 38*a* contacts adhesive layer 50. As used herein, a minor portion of the back sheet means less than one-half of the sheet. As seen in FIG. 3A, the minor portion is panel 38*a* which is approximately one-third of the entire back page. With respect to the booklet of FIG. 4, the minor portion is approximately one-quarter of the entire back page. A minor portion of the label means less than one-half of the label's front surface. As seen in FIG. 1, the minor portion 16 is approximately two-fifths of the entire front surface of the label.

For an eight page (FIG. 2C) folded booklet (FIG. 3C) with D=3L, the minor portion of the booklet only occupies 1/24 of the booklet's pages or 4.2%. For an eight page folded booklet with D=4L (FIG. 4), the minor portion of the booklet only occupies 1/32 of the booklet's pages or 3.1%. Accordingly, the booklet format and folding configuration of the invention provides a compact instructional booklet wherein greater than 95% of the surface area is available for printing. The folded booklet of FIG. 3C increases the available surface area of the unvarnished region by 23 times. The folded booklet of FIG. 4 would increase the available surface area of the unvarnished region by 31 times.

Figure 6:
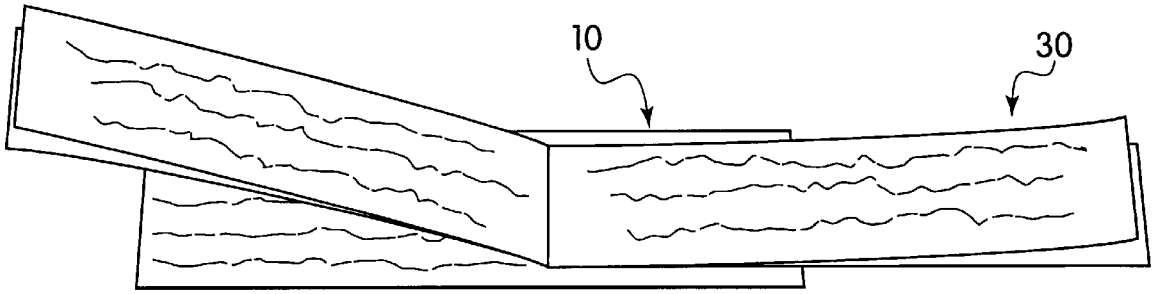
FIG. 6 is a perspective view showing the booklet opened to an interior page thereof.

Adhesive layer 50 may be a releasable adhesive wherein the final folded booklet 30*z* may be detached from label 10 without damaging the back surface of spine panel 38*a*. For example in the case of a single use product, booklet 30*z* can be removed for convenient reference by the user. Alternatively adhesive layer 50 may be a permanent adhesive having greater adhesive strength than adhesive dot 46. Accordingly, booklet 30 may be opened and read while remaining attached to label 10 as shown in FIG. 6. Adhesive dot 46 may be a releasable adhesive so that after the booklet is read, it may be refolded and re-secured in its initial state, as shown in FIG. 5. Alternatively adhesive dot 46 may be a permanent adhesive so that upon lifting the tab member at least one of the pages in contact with adhesive 46 becomes damaged evidencing that the booklet was opened.

The label of FIG. 5 is ideally suited for placement onto a curved or cylindrical container 60. Spine 34 as well as all of the folds remain flat, straight and parallel, with the various panels conforming to the arc of the container. Accordingly, unfolding the booklet, reading the booklet and refolding the booklet may take place without interference from the curved product container.

As can be seen, the various objects of the invention have been met with the combination label and booklet described herein. A permanent identifying label is provided which can be adhered to flat or curved surfaces like any conventional label. A large capacity instructional booklet is adhered to the label in a manner which only occupies minor portions of the label and booklet. The adhesive on the label and the adhesive dot within the booklet may be selected from various types to accommodate different applications. The booklet may be easily folded and secured with releasable adhesive when not in use.

Accordingly, while only several embodiments of the present invention have been shown and described, it is obvious that many changes and modifications may be made thereunto without departing from the spirit and scope of the invention.

What is claimed is:

1. A label bearing an adhesively-mounted folded instructional booklet having a spine of length L, wherein the adhesively-mounted booklet comprises:

at least two sheets extending orthogonally from the spine in a longitudinal direction a distance D and terminating in free ends thereof, wherein the booklet is folded in the longitudinal direction at least twice with said free ends enclosed within the folded booklet; and means for adhering a minor portion of one side of one sheet to a minor, unvarnished portion of a label so that the remainder of the label is visible adjacent the folded booklet.

2. The booklet of claim 1, wherein the remainder of the label extends outwardly from the minor unvarnished portion in the longitudinal direction.

3. The booklet of claim 1, wherein said booklet is divided longitudinally into at least three panels, wherein said at least three panels, overlie each other within the folded booklet.

4. The booklet of claim 3, comprising a dot of adhesive to maintain the booklet in its folded form, wherein one panel borders the spine and includes (i) an upper surface bearing said dot of adhesive, and (ii) a lower surface which constitutes the minor portion adhered to the label.

5. The booklet of claim 4, wherein the adhesive on said lower surface has a greater adhesive strength that said dot of adhesive so that the booklet may be unfolded while remaining adhered to the label.

6. The booklet of claim 4, wherein one panel borders the spine and has a length which is shorter than another of said panels which extends beyond said spine in the folded booklet forming a tab portion.

7. The booklet of claim 6, wherein the tab portion faces the remainder of the label which extends outwardly from the booklet in the longitudinal direction.

8. The booklet of claim 1, wherein said adhering means comprises an adhesive printed completely over the minor, unvarnished portion of the label.

9. The booklet of claim 1, comprising a top exterior sheet and a bottom exterior sheet formed from a unitary piece having a fold at the spine.

10. The booklet of claim 9, comprising a first interior sheet and a second interior sheet formed from a further unitary piece having a fold at the spine.

11. The booklet of claim 10, comprising means for binding said unitary piece to said further unitary piece at the spine.

12. A two part identifying and instructional document comprising in combination:

a label having a back side adapted to be adhered to a product container and a front side having an unvarnished region; and a multi-page booklet including (i) a spine, (ii) spaced-opposite free ends, (iii) a base panel adjacent said spine having a front surface and a back surface adhered to said unvarnished region, (iv) at least two additional panels which are folded over to enclose said free ends, wherein said folded over additional panels are adhered to said front surface of said base panel.

13. The apparatus of claim 12, wherein said folded over additional panels extend outwardly beyond the spine to define a tab portion.

14. The apparatus of claim 12, wherein the front side of the label has a product-identifying region which is visible adjacent the folded over panels of the booklet.

15. The apparatus of claim 14, wherein the product-identifying region of the label is covered with varnish.

16. The apparatus of claim 14, wherein said folded over additional panels extend outwardly beyond the spine in the direction of the product-identifying region to define a tab portion.

17. The apparatus of claim 12, comprising an adhesive printed continuously over said unvarnished region of the label.

18. The apparatus of claim 12, comprising a dot of adhesive on the front surface of said base panel of said booklet adjacent the spine.

19. The apparatus of claim 13, wherein each page of the booklet has at least about 50% greater surface area then the product-identifying region of the label.

20. The apparatus of claim 12, wherein the booklet comprises a back cover which includes the back surface, wherein the back cover is at least twice as large as the back surface.

* * * * *